US008154182B2

(12) United States Patent
Kano et al.

(10) Patent No.: US 8,154,182 B2
(45) Date of Patent: Apr. 10, 2012

(54) LIGHT SOURCE DEVICE

(75) Inventors: Yosuke Kano, Gyoda (JP); Makoto Okahara, Gyoda (JP); Kouji Komata, Gyoda (JP); Yousuke Ishikawa, Gyoda (JP)

(73) Assignee: Iwasaki Electric Co., Ltd., Tokyo (JP)

( * ) Notice: Subject to any disclaimer, the term of this patent is extended or adjusted under 35 U.S.C. 154(b) by 0 days.

(21) Appl. No.: 13/120,300

(22) PCT Filed: Apr. 23, 2009

(86) PCT No.: PCT/JP2009/058057
§ 371 (c)(1),
(2), (4) Date: Apr. 28, 2011

(87) PCT Pub. No.: WO2010/041484
PCT Pub. Date: Apr. 15, 2010

(65) Prior Publication Data

US 2011/0204765 A1 Aug. 25, 2011

(30) Foreign Application Priority Data

Oct. 8, 2008 (JP) ..... 2008-261534

(51) Int. Cl.
*H01J 5/16* (2006.01)

(52) U.S. Cl. ..... 313/113; 313/567

(58) Field of Classification Search ..... 313/483–493, 313/623, 627–643, 567, 111–117, 25–27, 313/317, 318.01–318.09; 439/615, 739; 445/24, 26, 29, 22
See application file for complete search history.

(56) References Cited

U.S. PATENT DOCUMENTS

| | | | |
|---|---|---|---|
| 6,400,087 | B2 | 6/2002 | van den Nieuwenhuizen et al. |
| 6,563,267 | B1 | 5/2003 | van den Nieuwenhuizen et al. |
| 2008/0258622 | A1 | 10/2008 | Yamamoto et al. |
| 2009/0224667 | A1 * | 9/2009 | Fujii et al. ..... 313/567 |

FOREIGN PATENT DOCUMENTS

| | | |
|---|---|---|
| JP | 8-87984 | 2/1996 |
| JP | 9-265947 | 10/1997 |
| JP | 2002-151006 | 5/2002 |
| JP | 2003-523055 | 7/2003 |
| JP | 2003-526182 | 9/2003 |
| JP | 2004-335457 | 11/2004 |
| JP | 3137961 | 12/2007 |
| JP | 2008-135194 | 6/2008 |
| WO | 2004/090934 | 10/2004 |

* cited by examiner

*Primary Examiner* — Nimeshkumar Patel
*Assistant Examiner* — Donald Raleigh
(74) *Attorney, Agent, or Firm* — Greenblum & Bernstein, P.L.C.

(57) ABSTRACT

A light source apparatus is capable of reliably enhancing the starting performance of a high pressure discharge lamp even during hot state just after extinguishing the high pressure discharge lamp by radiating a necessary and sufficient amount of a UV-light into a discharge bulb of the lamp using an UV-enhancer of a simple constitution without increasing the manufacturing cost is provided. An UV-enhancer for radiating a UV-light to a discharge bulb for enhancing the starting performance of a high pressure discharge lamp upon starting lighting includes a discharge tube connected in parallel to a lighting circuit of the lamp, and an external electrode of the discharge tube is formed as a metal holder that holds the outer periphery of the discharge tube so as to oppose the end face of an electrode seal portion of the lamp inserted through a bottom hole in a concave reflector and secures the electrode seal portion to an electrode lead protruding from the end face thereof.

20 Claims, 6 Drawing Sheets

LIGHT SOURCE DEVICE

TECHNICAL FIELD

The present invention concerns a light source apparatus used, for example, in liquid crystal projectors.

BACKGROUND ART

In liquid crystal projectors and DLP projectors such as data projectors and projectors for home theaters which are required to be small in the size and provide bright projection images, short arc type high pressure mercury vapor discharge lamps small in the size and capable of obtaining lighting at high luminosity have been used as light source apparatus therefor. However, since the high pressure discharge lamps of this type involve a problem that the starting performance during a cold condition and re-starting performance upon hot restrike are not generally favorable. Therefore, it is necessary to provide means for enhancing the starting performance. However, since a space is not available for allowing location of a starting auxiliary electrode, etc. that promotes arc discharge between electrodes upon start of ignition to be disposed in the discharge bulb of a small-sized lamp, the lamp voltage upon starting the high-pressure discharge lamp has been set to a somewhat higher level and a starting voltage such as a high frequency voltage or a high frequency pulse voltage has been applied to promote arc discharge between the electrodes.

However, when the voltage of the high frequency pulse applied between the electrodes is increased in order to enhance the starting performance of the high-pressure discharge lamp, since the voltage leak has to be prevented by extending the insulation distance between wirings forming a lighting circuit of the lamp, this not only results in a problem that the size of the lighting circuit is increased and the size of the liquid crystal projector cannot be decreased, as well as it may possibly generate noises which cause erroneous operation to electronic circuits etc. of the liquid crystal projector.

Then, in a high-pressure discharge lamp 51A shown in FIG. 7, for starting ignition by high frequency pulses at a relatively low voltage, a metal wire 53 referred to as a trigger wire/antenna wire is disposed outside of an arc tube 52 for promoting discharge between electrodes 56 and 56. That is, the lamp tube 51A is a short arc type high voltage mercury vapor discharge lamp in which a pair of tungsten electrodes 56 and 56 are opposed each other at a short inter-electrode distance of about 1 mm in a discharge bulb 54 of an arc tube 52 comprising a quartz glass tube, mercury and a starting gas comprising a halogen such as bromine and an argon gas are sealed, a pair of electrode seal portions 59R and 59L are formed by airtightly sealing portions from the discharge bulb 54 to both ends of the arc tube 52 by means of shrinking seal to seal electrodes 56, metal foils 57, and electrode leads 58 of electrode assemblies 55 inserted through both ends thereof, and connected to a lighting circuit by way of the electrode leads 58 and 58 protruded from the ends of each of the electrode seal portions 59R, 59L. The metal wire 53 for enhancing the starting performance of the lamp is connected at one end 53*a* to an electrode lead 58 that protrudes from the end of the electrode seal portion 58R on one side of the arc tube 52 and wound around at the other end 53*b* in a loop-form or a spiral-form around the outer periphery of the electrode seal portion 59L on the other side of the arc tube 52 (refer to Patent documents 1 to 4).

When the metal wire 53 is wired in close contact with or approximate to the surface of the arc tube 52, the starting performance of the lamp 51A is enhanced more. However, this results in a problem that the re-starting performance upon hot re-strike is not favorable since the wire is extended due to thermal expansion by being heated at a high temperature of about 900° C. to 1000° C. upon lighting of the lamp and recedes from the surface of the arc tube 52. Further, since the metal wire 53 is entirely slackened or distorted by the generation of extension due to thermal expansion, it tends to recede from the surface of the arc tube 52, as well as the once slackened or distorted metal wire 53 does not restore the initial state where it was in close contact with or approximate to the surface of the arc tube 52 even when the wire is cooled and thermally shrank after distinguishing the lamp, the starting performance during cold condition is also deteriorated.

[Patent document 1] JP-A No. 2004-335457
[Patent document 2] JP-A No. 9-265947
[Patent document 3] JP-A No. 8-87984
[Patent document 4] Re-laid open publication No. 2004-90934

Then, a high pressure discharge lamp 51B shown in a plan view of FIG. 8(*a*) and in a fragmentary enlarged cross sectional view of FIG. 8(*b*) is configurated such that when electrode seal portions 59R and 59L are formed by shrink sealing both ends of an arc tube 52, a cavity 60 for containing a portion of a metal foil 57 is formed in one electrode seal portion 59L and, at the same time, fabrication of sealing a rare gas such as an argon gas containing mercury vapor in the cavity 60 is applied, one end of a metal wire 53 connected at other end to an electrode lead 58 that protrudes from the end face of the electrode seal portion 59R is wound around the outer periphery of the electrode seal portion 59L having the cavity 60 formed therein, whereby high frequency pulse voltage is applied between the metal wire 53 and the metal foil 57 contained in the cavity 60 of the electrode seal portion 59L to cause grow discharge in the mercury vapor in the cavity 60. The mercury is excited by the glow discharge to generate a UV-light, which excites the starting gas sealed in a discharge bulb 54 to promote arc discharge between the electrodes 56 and 56 (refer to Patent document 5).

However, since it is extremely troublesome to apply fabrication of forming the cavity 60 in the electrode seal portion 59L of the arc tube 52 and seal a mercury vapor-containing rare gas in the cavity 60 in the course of manufacturing the high pressure discharge lamp 51B, and the amount of mercury and the volume, gas pressure, etc. of the rare gas to be sealed in the cavity 60 have to be controlled properly in order to generate a necessary amount of a UV-light by glow discharge, the fabrication is troublesome and may remarkably lower the lamp productivity. Further, when the cavity 60 is formed in the electrode seal portion 59L of the arc tube 52, the mechanical strength of the electrode seal portion 59L is lowered to possibly cause breakage of the arc tube 52.

Further, during lighting of the high pressure discharge lamp, since the atmospheric temperature in a concave reflector to which the lamp is attached generally rises to a high temperature of 300° C. or higher in average, the mercury vapor pressure in the cavity 60 increases excessively in the high pressure discharge lamp 51B shown in FIG. 8 under the effect of such high temperature. Therefore, even when a high frequency pulse voltage for starting is applied between the metal foil 57 and the metal wire 53, since the mercury vapor pressure in the cavity 60 remains excessively high for a while after extinguishing the lamp and the glow discharge is not caused. Glow discharge can be obtained only after the atmospheric temperature in the concave reflector is lowered to about 100° C. in average. Accordingly, the high pressure discharge lamp 51B involves a problem that the re-starting performance is not favorable during hot strike of re-ignition just after the lamp is distinguished.

[Patent document 5] JP-T 2003-526182

Then, in a light source apparatus shown in FIG. 9, a high pressure discharge lamp 51C having substantially the same basic structure as that in the high pressure discharge lamp 51A shown in FIG. 7 is attached integrally with a reflector 61, by inserting an electrode seal portion 59L on one side through a bottom hole 62 apertured in the bottom of the concave reflector 61, and an ignition antenna 63 as a UV-enhancer that radiates a UV-light to a discharge bulb 54 for enhancing the starting performance of the lamp 51C upon ignition thereof is disposed in parallel with the optical axis of an arc tube 52 along the outer periphery of the electrode seal portion 59L (refer to Patent document 6).

The ignition antenna 63 has a configuration, as shown in an enlarged view of FIG. 10(*a*) and a cross sectional view along X-X in FIG. 10 (*b*) that an ionizing filler (mercury and argon gas) is filled in an antenna vessel 64 comprising a quartz glass tube having a long straight tube portion 65*a* extending along the electrode seal portion 59L to the vicinity of the discharge bulb 54 of the lamp 51C, and a bent tube portion 65*b* bent into a semi-arcuate shape so as to be wound around for 180° C. over the outer periphery of the electrode seal portion 59L at the top end of the long straight tube portion 65*a*, an electric conductor element 66 comprising a metal foil (molybdenum foil) is contained and disposed in the straight tube portion 65*a* on the side of the free end of the antenna vessel 64, and an external electrode 67 comprising a metal bush is fitted to the straight tube portion 65*a* on the side of the free end.

In the ignition antenna 63, a portion of an external electrode 67 is secured by a cement 68 to the outer periphery of the electrode seal portion 59L, and the external electrode 67 is connected by way of a current supply conductor 69 to the output portion of voltage transformer means 71 connected between current conductors 70R and 70L that form a lighting circuit of the high pressure discharge lamp 51C. When a starting voltage such as a high frequency AC voltage or a pulse voltage is applied between the external electrode 67 and the electric conductor element 66 in the antenna vessel 64, electric discharge is caused therebetween to generate a UV-light, and the UV-light is radiated by way of the straight tube portion 65*a* and the bent tube portion 65*b* of the antenna vessel 64 into the discharge bulb 54 of the lamp 51C thereby promoting arc discharge between the electrodes 56 and 56.

However, the antenna vessel 64 in which the straight tube portion 65A and the bent portion 65B are contiguous with each other is troublesome and involve a drawback of increasing the manufacturing cost. Further, since the antenna vessel 64 is adjacent at the bent tube portion 65*b* with the discharge bulb 54 of the lamp 51C which is heated to a high temperature of about 1000° C. upon lighting the lamp, discharge between the external electrode 67 and the electric conductor element 66 become instable just after distinguishing the lamp under the effect of the high temperature to result in a problem that the re-starting performance upon hot re-strike is not favorable and, at the same time, the antenna vessel 64 may be possibly broken undergoing thermal damages.

Further, there is also a disadvantage that the UV-light generated by discharge between the external electrode 67 and the electric conductor element 66 is decayed by being reflected, diffracted, or absorbed to the filler in the antenna vessel 64 in the course of passage byway of the long straight portion tube 65*a* and the bent tube portion 65*b* of the antenna vessel 64 into the discharge bulb 54 of the lamp 51C. Further, since the bent tube portion 65*b* of the antenna vessel 64 is disposed in adjacent with one side of the discharge bulb 54 of the lamp 51C, this may result in a disadvantage that the temperature distribution during lighting of the lamp is remarkably different between one side and the opposite side of the discharge bulb 54 of the lamp 51C which may possibly deteriorate the lamp life and that the bent tube portion 65*b* of the antenna vessel 64 shields a portion of alight emitted from the discharge bulb 54 of the lamp 51C to the bottom of the concave reflector 61 to lower the light utilization efficiency of the lamp. Further, there may be a possibility that the ignition antenna 63 is detached from the outer periphery of the electrode seal portion 59L due to the aging deterioration (thermal degradation) of a cement 68 that secures the ignition antenna 63 to the outer periphery of the electrode seal portion 59L.

[Patent document 6] JP-T 2003-523055

Then, the present applicant has proposed a light source apparatus as shown in FIG. 11 in which a glow discharge tube 80 that generates a UV-light upon starting lighting of a high pressure discharge lamp 51D is disposed at a position capable of radiating the UV-light from the outside of a concave reflector 81 through a vent hole 82 for cooling air formed in the reflector to the discharge bulb 54 of the lamp 51D (refer to Patent document 7).

In the light source apparatus in FIG. 11, a high pressure discharge lamp 51D having an identical basic structure with that of the high pressure discharge lamp 51A shown in FIG. 7 or the high pressure discharge lamp 51C shown in FIG. 9 is attached integrally with the reflector 81 by inserting a sealing portion 59L on one side through a bottom hole 83 apertured in the bottom of the concave reflector 81, and a glow discharge tube 80 as a UV-enhancer that radiates a UV-light for enhancing the starting performance upon starting lighting of the lamp 51D to the discharge bulb 54 is disposed outside of the reflector 82. Accordingly, the discharge tube 80 is not heated to a high temperature during lighting and the mercury vapor pressure inside the tube is not increased excessively and glow discharge can be caused to generate a UV-light also in the hot state just after distinguishing the lamp.

Further, the glow discharge lamp 80 has a simple structure in which a rare gas such as an argon gas containing mercury vapor is sealed inside a glass sealing tube 84 comprising quartz glass and an internal electrode 85 comprising a metal foil having a pair of lead wires 86 and 86 protruding from both ends of the glass sealing tube 84 are contained and disposed therein, and a coiled external electrode 87 formed by winding a chromium/aluminum/iron alloy wire 89 of about 0.2 mm diameter is disposed to the outer periphery of the glass sealing tube 84. Accordingly, this provides an advantage that the manufacturing cost is not increased.

Then, the internal electrode 85 and the external electrode 87 of the glow discharge tube 80 are connected to one side 88R and the other side 88L of the lamp lighting circuit, a high frequency pulse voltage for staring is applied between the internal electrode 85 and the external electrode 87, whereby glow discharge is caused in the mercury vapor in the glass sealing tube 84 as a main body of the discharge tube 80 to generate a UV-light, and a portion of the UV-light is radiated through a vent hole 82 for cooling air formed in the reflector 81 to the discharge bulb 54 of the lamp 51D disposed inside the reflector 81 directly or radiated after reflection on the reflection surface of the reflection mirror 81.

However, when the position for locating the discharge tube 80 is far from the vent hole 82 of the reflector 81, the amount of the UV-light radiated through the vent hole 82 to the inside of the reflector 81 is decreased to result in a problem of lowering the starting performance of the lamp. On the other hand, when the discharge tube 80 is disposed in adjacent with the vent hole 82 in the reflector 81, since the discharge tube 80 closes the vent hole 82 to hinder the flow of the cooling air, this results in a problem of lowering the cooling effect for the lamp 52D.

Further, when the number of turns of the coils of the coiled external electrode 87 disposed to the outer periphery of the discharge tube 80 is small, since the amount of the UV-light to be generated is small, a necessary and sufficient amount of the UV rays cannot be radiated into the discharge bulb 54 of the lamp 51D. On the other hand, when the number of turns of the coils of the coiled external electrode 87 is increased, the UV-light is shielded by the external electrode 87 to result in a problem that a necessary and sufficient amount of the UV-light cannot be radiated into the discharge bulb 54 of the lamp 51D.

[Patent document 7] Registered Utility Model No. 3137961

DISCLOSURE OF THE INVENTION

Subject to be Solved by the Invention

The present invention has a technical subject of providing a light source apparatus capable of efficiently radiating a necessary and sufficient amount of a UV-light into a discharge bulb of a high pressure discharge lamp by a UV-enhancer of a simple constitution not increasing the manufacturing cost and, at the same time, capable of reliably operating the UV-enhancer thereby enhancing the starting performance of the high pressure discharge lamp also during hot state also just after extinguishing the lamp and free from a worry that the UV-enhancer suffers from thermal damages due to the heat at high temperature generated during lighting of the lamp.

Means for Solving the Subject

For solving the subjects described above, the present invention provides a light source apparatus including a high pressure discharge lamp in which a pair of electrodes are opposed each other, at least mercury and a starting gas are sealed in a discharge bulb of an arc tube, a pair of electrode seal portions sealing each of the electrodes are formed by airtightly sealing portions from the discharge bulb to both ends of the arc tube, and connected to a lighting circuit by way of electrode leads protruding from the end faces of the respective electrode seal portions;

a concave reflector in which the lamp is attached by being inserted at one of the electrode seal portions through a bottom hole opened in the bottom of the reflector; and a UV-enhancer that radiates a UV-light to the discharge bulb for enhancing the starting performance of the lamp upon starting lighting, wherein the UV-enhancer has a discharge tube which is connected in parallel with the lamp to the lighting circuit for applying a starting voltage between the electrodes upon starting lighting of the lamp and which generates a UV-light by application of the starting voltage between an external electrode and an internal electrode, the external electrode of the discharge tube is formed of a metal holder that holds the outer periphery of the discharge tube so as to oppose the end face of one of the electrode seal portions and secures the same to the electrode lead protruding from the end thereof, and the holder includes a holder body that holds the outer periphery while exposing the surface of the outer periphery opposing the end face of one of the electrode seal portions and a terminal for securing and electrically connecting the holder to the electrode lead.

Effect of the Invention

According to the present invention, since the discharge tube as the UV-enhancer of the high pressure discharge lamp is disposed at a position opposing the end face of the electrode seal portion of the high pressure discharge lamp inserted through the bottom hole opened in the bottom of the concave reflector, the discharge tube is free from the worry of suffering from thermal damages by undergoing the effect of heat at high temperature generated during lighting of the lamp and at the same time can cause stable discharge also during the hot state just after distinguishing the lamp thereby capable of generating a UV-light reliably.

Further, since the discharge tube is held by the metal holder as the external electrode such that the outer periphery of the discharge tube is opposed the end face of the electrode seal portion of the high pressure discharge lamp, and held so as to expose the surface of the outer periphery thereof opposing the end face of the electrode seal portion, the generated UV-light can be entered reliably into the end face of the electrode seal portion of the high pressure discharge lamp and can be radiated efficiently through the electrode seal portion to the inside of the discharge bulb of the lamp. Further, since the external electrode comprising the metal holder for holding the outer periphery of the discharge tube has an electrode area sufficient to generate a necessary amount of the UV-light, starting performance of the high pressure discharge lamp can be improved remarkably.

DESCRIPTION FOR REFERENCES

Figure 1:
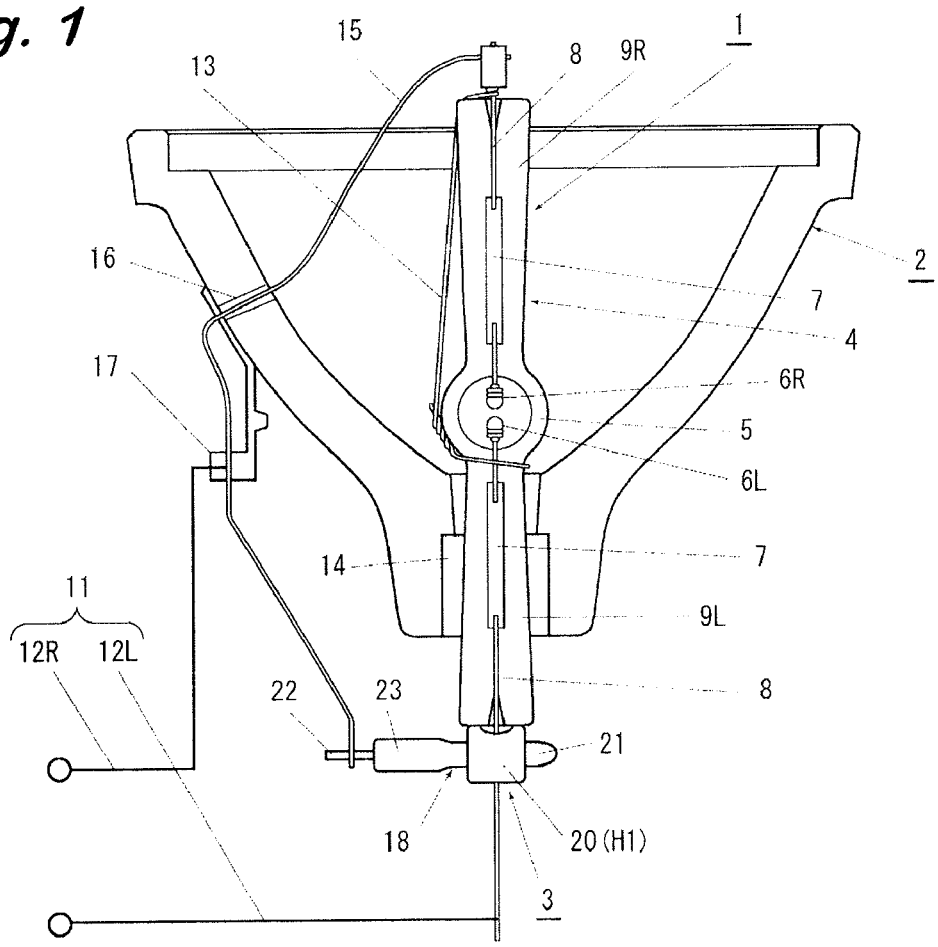
[FIG. 1] is an entire view showing an example of a light source apparatus according to the present invention.

1 . . . high pressure discharge lamp
2 . . . concave reflector
3 . . . UV-enhancer
4 . . . arc tube
5 . . . discharge bulb
6R . . . electrode
6L . . . electrode
7 . . . metal foil
8 . . . electrode lead
9R . . . electrode sealed portion
9L . . . electrode sealed portion
10 . . . end face of electrode seal portion
11 . . . lighting circuit
14 . . . bottom hole in a concave reflector
18 . . . discharge tube

19 . . . internal electrode
20 . . . external electrode
24 . . . outer periphery of the discharge tube
H1 . . . holder
H2 . . . holder
H3 . . . holder
25 . . . holder body
26 . . . terminal (tab terminal)
27 . . . window
H4 . . . holder
31 . . . holder body
32 . . . terminal (sleeve terminal)
33 . . . step
34 . . . perforated hole

BEST MODE FOR PRACTICING THE INVENTION

A best mode for practicing the light source apparatus according to the present invention includes a high pressure discharge lamp in which a pair of tungsten electrodes are disposed opposite each other and mercury and a starting gas such as halogen and an argon gas are sealed in a discharge bulb of an arc tube comprising a quartz glass tube, a pair of electrode seal portions sealing each of the electrodes are formed by airtightly sealing portions from the discharge bulb to both ends of the arc tube and which is connected to a lighting circuit by way of electrode leads comprising molybdenum wires protruding from the end faces of respective electrode seal portions; a concave reflector in which the lamp is attached by inserting one of the electrode seal portions through the bottom hole opened in the bottom of the reflector; and a UV-enhancer for radiating a UV-light for enhancing the starting performance of the lamp upon starting the lighting thereof.

The UV-enhancer comprises a discharge tube connected in parallel with the lamp to a lighting circuit for applying a starting voltage between the tungsten electrodes upon starting lighting of the lamp and generating UV-light by the application of a starting voltage between an external electrode and an internal electrode, the external electrode of the discharge tube comprises a metal holder for holding the outer periphery of the discharge tube so as to oppose the end face of one of the electrode seal portions and securing the same to the electrode lead protruding from the end face, and the holder comprises a holder body for holding the outer periphery while exposing the surface of the outer periphery opposite the end face of one of the electrode seal portions and a terminal for securing and electrically connecting the holder to the electrode lead.

The main body of the discharge tube comprises a glass seal tube made of quartz glass, in which a rare gas such as an argon gas is sealed, an internal electrode comprising a metal foil such as a molybdenum foil is contained and disposed inside the glass sealing tube, and a lead welded to one end of the internal electrode protrudes from one end of the glass sealing tube. The filler in the discharge tube is not restricted onto the rare gas and it may also be a rare gas containing mercury vapor.

The holder body as the external electrode of the discharge tube is formed of a metal sheet such as a stainless steel for spring bent into a shape of gripping and holding the outer periphery of the discharge tube. The metal sheet is bent into a shape of griping and holding the outer periphery of the discharge tube at a position opposite the end face of one of the electrode seal portions and formed with a window for exposing the surface of the outer periphery opposing the end face, or bent into a shape of gripping and holding the outer periphery so as to expose the surface of the outer periphery of the discharge tube opposite the end face at a the position opposing the end face of one of the electrode seal portions.

Further, the terminal for securing and electrically connecting the holder to the electrode lead comprises a tub terminal formed from a portion of the metal sheet forming the holder body, and the tab terminal is bent so as to grip the electrode lead and spot welded to the electrode lead.

Example

Figure 2:
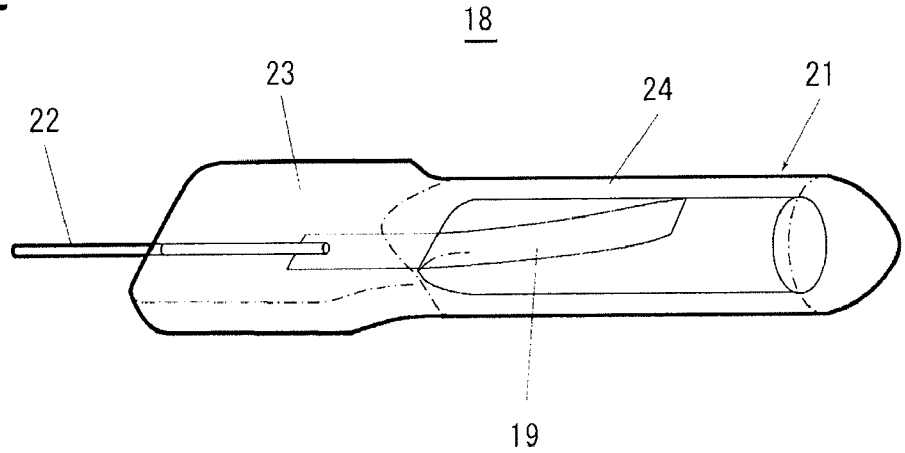
[FIG. 2] is a perspective view showing an example of a UV-enhancer of a high pressure discharge lamp.
Figure 3A:
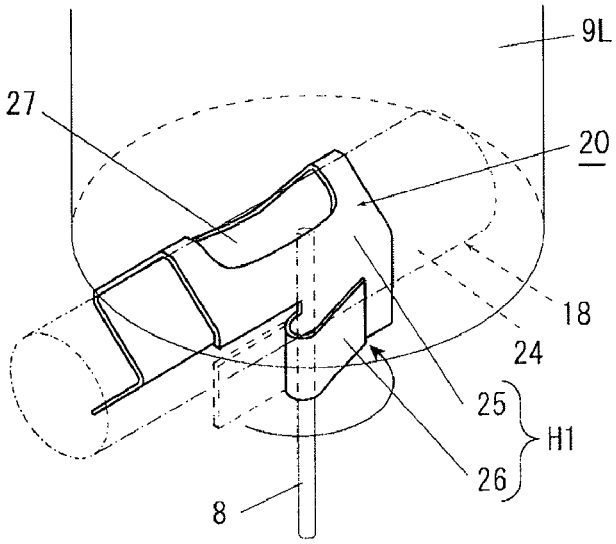
[FIG. 3] is a view showing an example of a holder forming an external electrode of a discharge tube as the UV-enhancer.
Figure 3B:
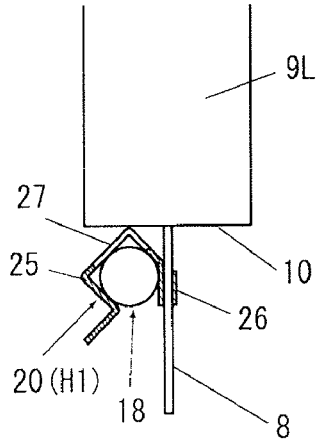
Figure 4A:
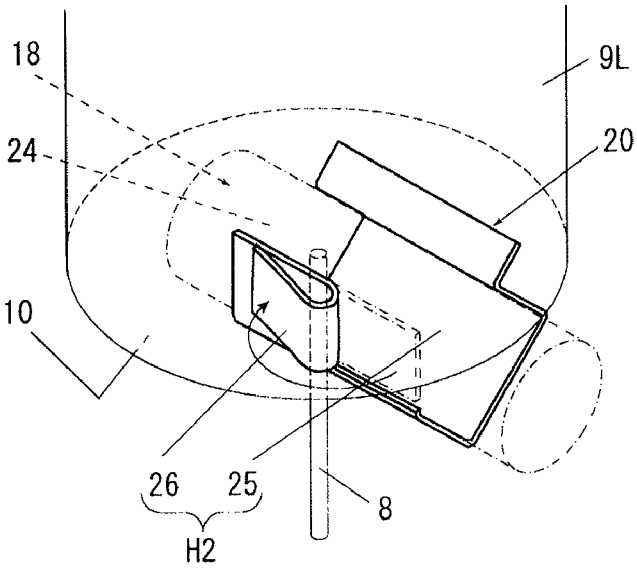
[FIG. 4] is a view showing a modified example of a holder forming the external electrode of the discharge tube.
Figure 4B:
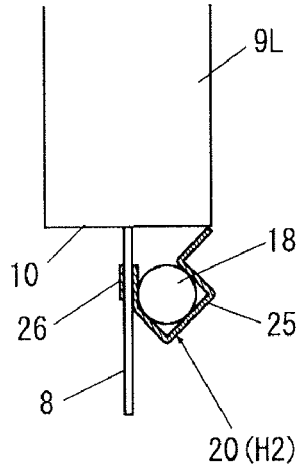
Figure 5A:
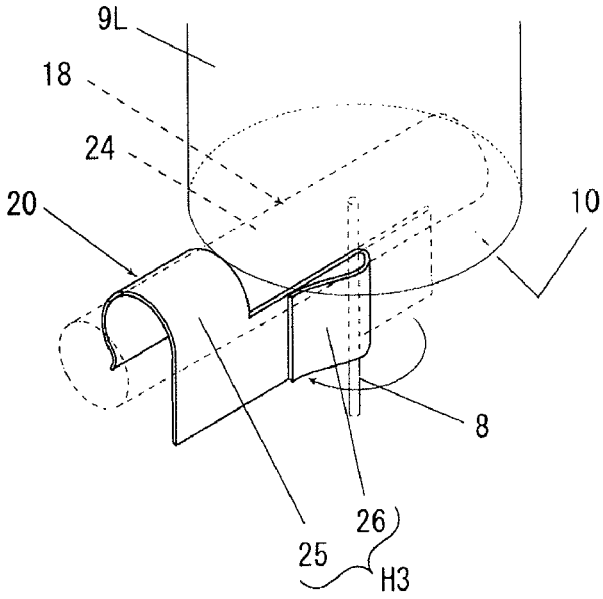
[FIG. 5] is a view showing a modified example of a holder forming the external electrode of the discharge tube.
Figure 5B:
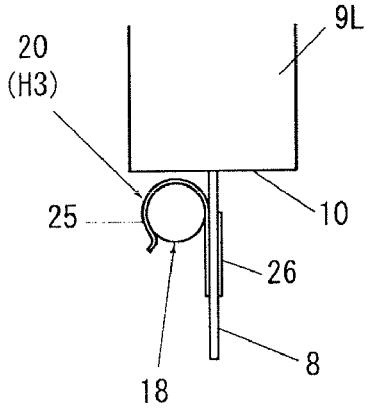
Figure 6A:
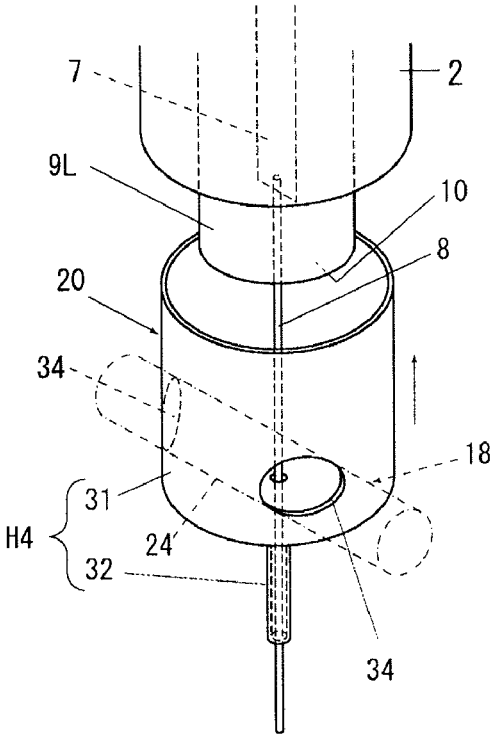
[FIG. 6] is a view showing a modified example of the holder forming the external electrode of the discharge tube.
Figure 6B:
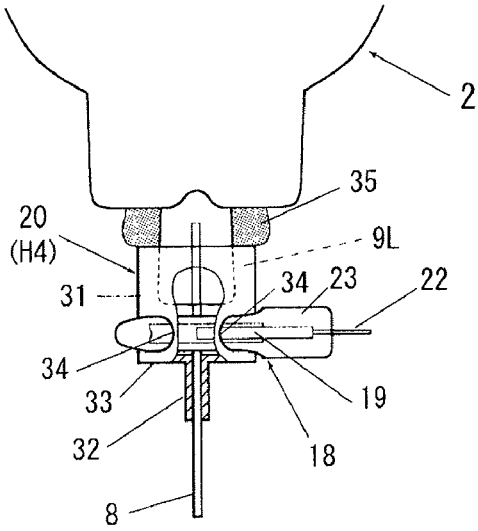
Figure 7:
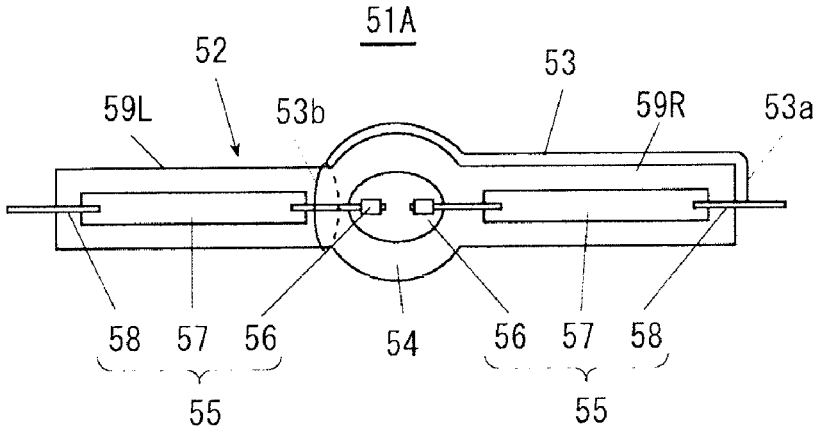
Fig. 7 (prior art)
[FIG. 7] is a view showing a prior art for enhancing the starting performance of a high pressure discharge lamp.
Figure 8A:
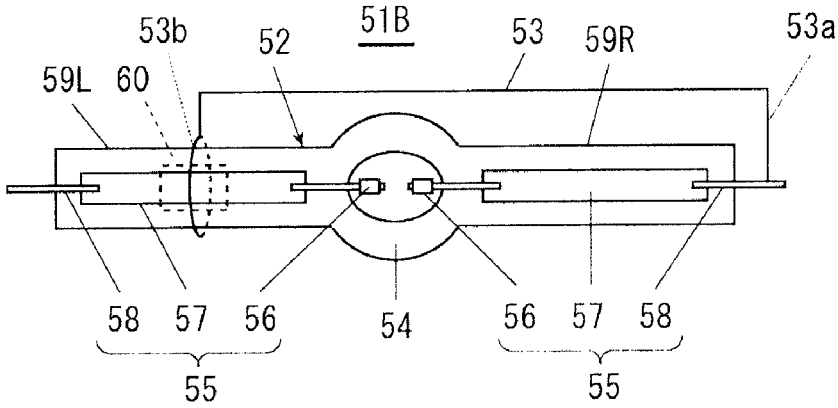
Fig. 8(a) (prior art)
[FIG. 8] is a view showing a prior art for enhancing the starting performance of a high pressure discharge lamp.
Figure 8B:
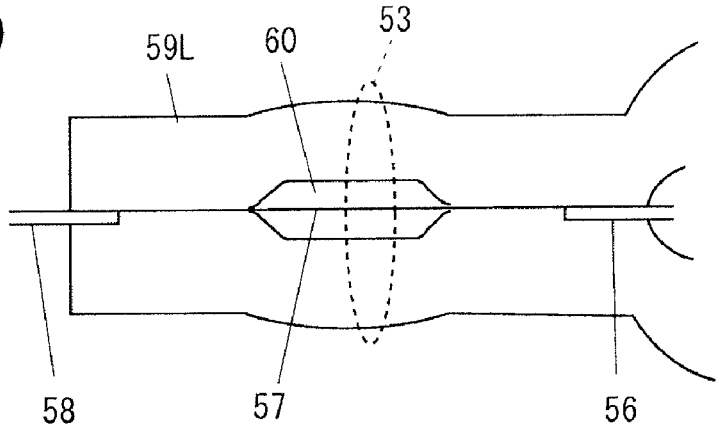
Fig. 8(b) (prior art)
Figure 9:
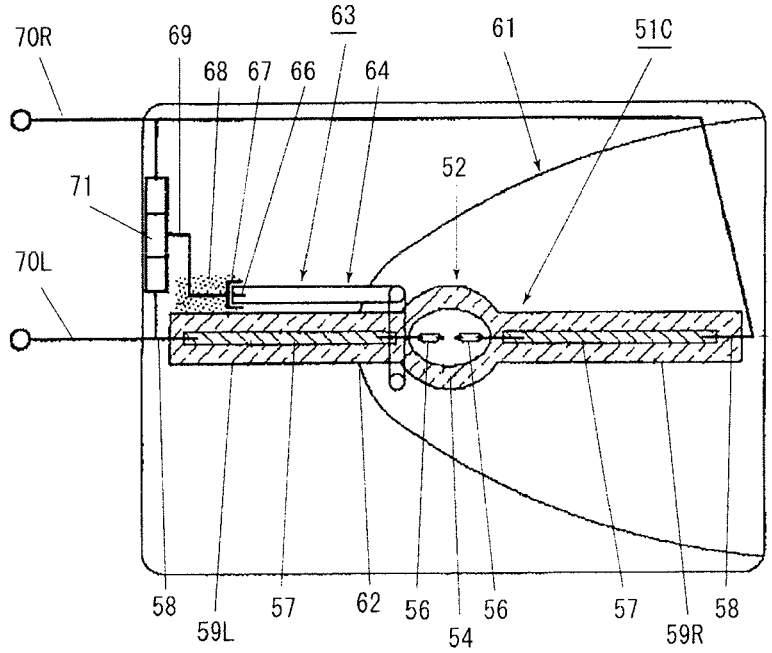
Fig. 9 (prior art)
[FIG. 9] is a view showing a prior art for enhancing the starting performance of a high pressure discharge lamp.
Figure 10A:
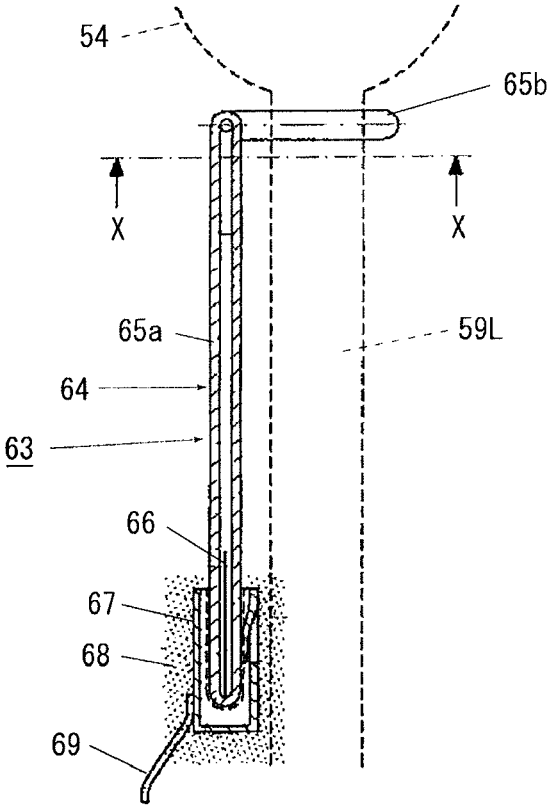
Fig. 10(a) (prior art)
[FIG. 10] is a view showing a prior art for enhancing the starting performance of a high pressure discharge lamp.
Figure 10B:
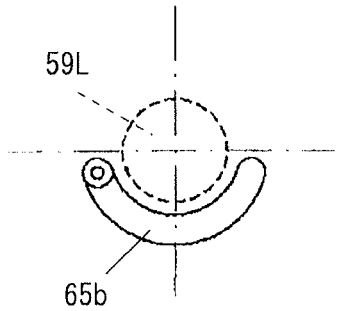
Fig. 10(b) (prior art)
Figure 11:
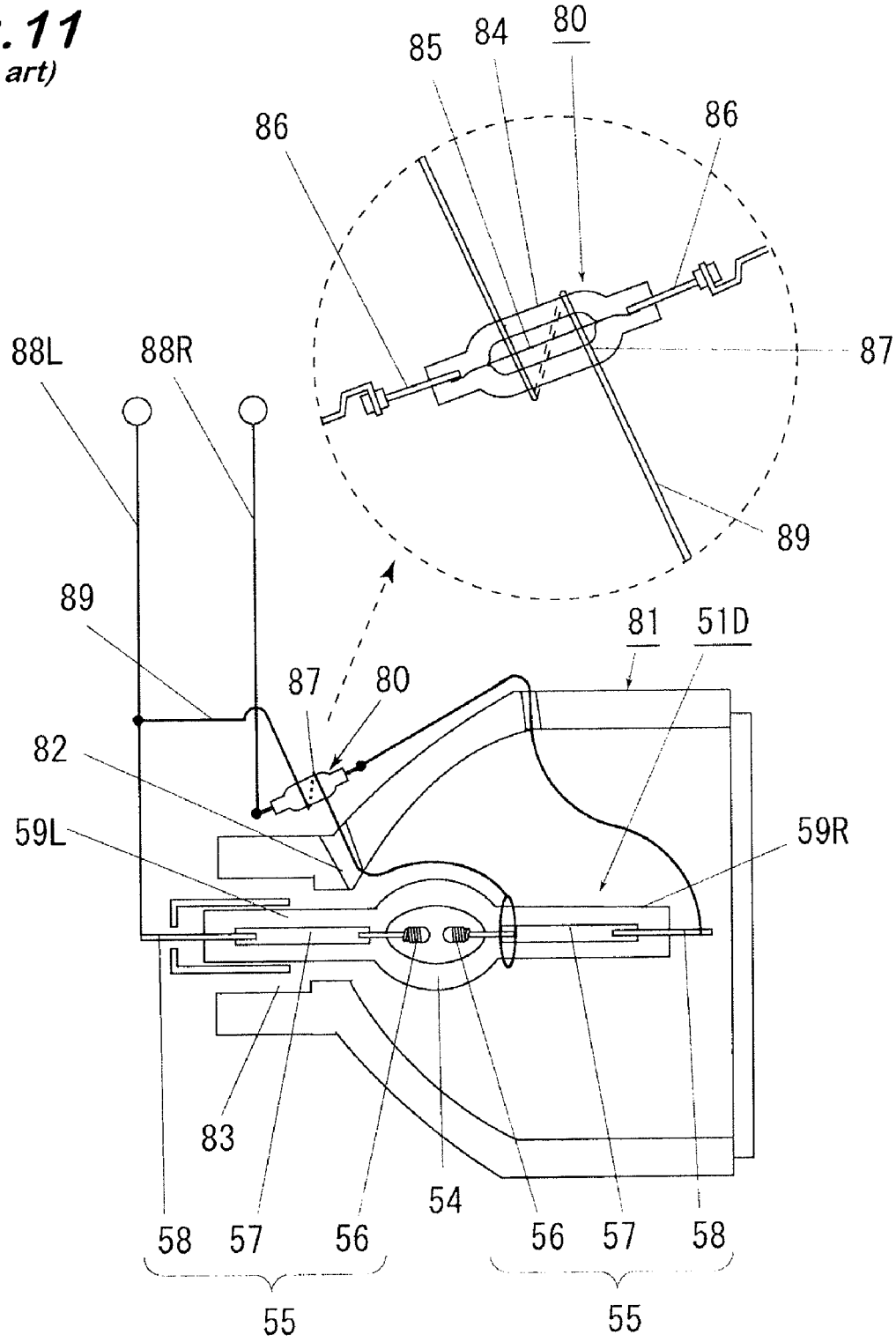
Fig. 11 (prior art)
[FIG. 11] is a view showing a prior art for enhancing the starting performance of a high pressure discharge lamp.

FIG. 1 is an entire view showing an example of a light source apparatus according to the present invention, FIG. 2 is a perspective view showing a UV-enhancer of a high pressure discharge lamp used for the light source apparatus, FIGS. 3 (*a*) and (*b*) are a perspective view and a side elevational view showing the constitution of a holder that forms an external electrode of a discharge tube as the UV-enhancer and the state of mounting the holder, respectively, FIGS. 4 (*a*) and (*b*) and FIGS. 5 (*a*) and (*b*) are a perspective view and a side elevational view showing a modified example of the holder and the state of attaching the holder respectively, and FIGS. 6 (*a*) and (*b*) are a perspective view and a partially cut away front elevatoinal view showing a modified example and a state of mounting the holder, respectively.

A light source apparatus shown in FIG. 1 includes a high pressure discharge lamp 1, a concave reflector 2 for reflecting a light emitted from the lamp 1, and a UV-enhancer 3 generating a UV-light for enhancing the starting performance of the lamp 1. In the lamp 1, a pair of tungsten electrodes 6R and 6L are disposed and opposed at a short inter-electrode distance of about 1 mm, and mercury and a starting gas such as a halogen, for example, bromine and an argon gas are sealed in a discharge bulb 5 of an arc tube 4 comprising quartz glass, and portions from the discharge bulb 5 to both ends of the arc tube 4 are airtightly sealed to form a pair of electrode seal portions 9R and 9L that seal each of the electrodes 6R and 6L, a metal foil 7 comprising a molybdenum foil connected therewith, and electrode leads 8 comprising molybdenum wires. Then, the electrode leads 8 and 8 protruding from the end faces 10 of respective electrode seal portions 9R and 9L are connected to one side 12R and the other side 12L of the lighting circuit 11 for supplying a lamp power, and a metal wire 13 as a trigger wire/antenna wire for promoting arc discharge between the electrodes 6R and 6L is wired such that one end thereof is connected with the electrode lead 8 protruding from the end face 10 of the electrode seal portion 9R and the other end thereof is wound around in a loop form along the outer periphery of the electrode seal portion 9L.

The concave reflector 2 has, at its bottom, a bottom hole 14 apertured therein for allowing the electrode seal portion 9L on one side of the high pressure discharge lamp 1 to pass therethrough and securing the same with a cement or the like and, at its reflection portion, a wiring hole 16 for allowing a lead wire 15 comprising a nickel wire connected to an electrode lead 8 protruding from the electrode seal portion 9R on the other side of the high pressure discharge lamp 1 to pass therethrough. A wiring metal 17 is secured at the back of the reflection portion for securing the lead wire 15 led out from the wiring hole 16.

The UV-enhancer 3 is connected in parallel with the lamp 1 to the lighting circuit 11 for applying a starting voltage between the electrodes 6R and 6L upon starting ignition of the high pressure discharge lamp 1 and generates a UV-light by the application of the starting voltage between the inner electrode 19 and the external electrode 20 of the discharge tube 18.

The main body of the discharge tube 18 is formed of a glass sealing tube 21 made of quartz glass and, in the inside of the glass sealing tube 21, a rare gas such as an argon gas is filled, and an internal electrode 19 comprising a metal foil such as a molybdenum foil having a lead wire 22 welded at one end is contained and disposed. The glass sealing tube 22 is sealed on one end by chipping off and pinch sealed at the other end in which a welded portion between the internal electrode 19 and the lead wire 22 is sealed in the pinch sealed portion 23. Further, the internal electrode 19 is connected by way of the lead wire 22 protruding from the pinch electrode seal portion 23 of the glass sealing tube 21 to one side 12R (on the side of electrode 6R) of the light circuit 11.

The external electrode 20 of the discharge tube 18 comprises a metal holder H1 that holds the outer periphery 24 of the discharge tube 18 so as to oppose the end face 10 of the electrode seal portion 9L of the lamp 1 inserted into the bottom hole 14 in the reflector 2 and secure the same to the electrode lead 8 protruding from the end face 10. The holder H1 comprises a holder body 25 formed of a metal sheet such as a stainless steel sheet (SUS 304-CSP) for spring of 0.2 mm thickness fabricated by bending into a shape of gripping and holding the outer periphery 24 of the discharge tube 18, and a terminal 26 that secures and electrically connects the same to the electrode lead 8 protruding from the end face 10 of the electrode seal portion 9L.

The metal sheet forming the body 25 of the holder H1 is bent into a shape of gripping and holding the discharge tube 18 so as to cover the outer periphery 24 of the tube at a position opposing to the end face 10 of the electrode seal portion 9L. A window 27 for exposing the surface of the periphery 24 opposing the end face 10 of the electrode seal portion 9L is formed to the metal sheet. Further, a tab terminal as a fixing terminal 26 is formed from a portion of the metal sheet and the tub terminal is bent from the state indicated by a chain line in FIG. 3 (*a*) so as to grip the electrode lead 8 as indicated by a solid line and spot welded to the electrode lead 8, whereby the discharge tube 18 is secured firmly to the electrode lead 8 comprising a rigid molybdenum wire, and the external electrode 20 comprising the metal holder H1 is connected electrically to the other side of the lighting circuit 11 (on the side of the electrode 6L).

Then, upon starting the lighting of the high pressure discharge lamp 1, a starting voltage is applied from the lighting circuit 11 to a portion between the internal electrode 19 and the external electrode 20 of the discharge tube 18 to cause electric discharge in the rare gas that excites the rare gas sealed in the glass seal tube 21 constituting the body of the discharge tube 18 thereby generating a UV-light and the UV-light is radiated from the window 27 formed in the body 25 of the holder H1 forming the external electrode 20, incident to the end face 10 of the electrode seal portion 9L of the lamp 1, transmitted and propagated inside the electrode seal portion 9L, and is radiated into the discharge bulb 5, whereby the starting gas sealed in the discharge bulb 5 is excited and tungsten forming the electrodes 6R and 6L emits initial electrons necessary for starting discharge and promote starting of the high pressure lamp 1.

Since the discharge tube 18 as the UV-enhancer 3 is inserted through the bottom hole 14 in the reflector 2 and disposed at a position opposing the end face 10 of the electrode seal portion 9L of the lamp protruding to the outside of the reflector 2, it is not heated to a high temperature during lighting of the lamp and, accordingly, can stably cause discharge to generate a UV-light also during the hot state just after extinguishing the lamp. Further, since the external electrode 20 of the discharge tube 18 is formed of the holder H1 comprising the metal sheet bent into the shape of gripping and holding the outer periphery 24 of the discharge tube 18 where the internal electrode 19 is contained and has a large electrode area, a UV-light can be generated in a necessary and sufficient amount for enhancing the starting performance of the lamp. Further, since the outer periphery 24 of the discharge tube 18 is opposed the end face 10 of the electrode seal portion 9L, the UV-light generated in the discharge tube 18 can be incident efficiently to the end face 10 of the electrode seal portion 9L.

Further, since the discharge tube 18 has a simple constitution, manufacturing cost thereof is not increased. Further, since the holder H1 for holding the outer periphery 24 of the discharge tube 18 is secured by welding to the electrode lead 8 of the lamp 1, there is no possibility that it detaches from the electrode lead 8. Further, since the electrode lead 8 is formed of a rigid molybdenum wire, there is no possibility of causing such a disadvantage that the electrode lead 8 is unintentionally bent and the outer periphery 24 of the discharge tube 18 held by the holder H1 does not oppose the end face 10 of the electrode seal portion 9L.

Further, in a holder H2 forming an external electrode 20 of a discharge tube 18 shown in FIG. 4, its holder body 25 is formed of a metal sheet comprising a stainless steel sheet for spring bent into a shape of gripping and holding the outer periphery 24 so that the surface of the outer periphery 24 of the discharge tube 18 opposing the end face 10 is exposed at a position opposing the end face 10 of the electrode seal portion 9L. A terminal 26 and a tab terminal for securing and electrically connecting the holder H2 to the lead 8 are formed from a portion of the metal sheet. That is, the metal sheet forming the holder H2 is bent into a shape covering the peripheral surface of the outer periphery 24 except for the surface of the outer periphery 24 of the discharge tube 18 opposing the end face 10 of the electrode seal portion 9L.

With the constitution described above, since the UV-light emitted from the outer periphery 24 of the discharge tube 18 to the end face 10 of the electrode seal portion 9L is incident directly to the end face 10 thereof and, at the same time, the UV-light emitted from the outer periphery 24 of the discharge tube 18 to the inner surface of the body 25 of the holder H2 is also reflected at the inner surface of the holder body 25 and incident to the end face 10 of the electrode seal portion 9L, the amount of the UV-light radiated into the discharge bulb 5 of the lamp 1 is increased to enhance the starting performance of the lamp remarkably.

Also in the holder H2 of FIG. 4, the terminal 26 comprising a tab terminal is bent from the state indicated by a chain line so as to grip the electrode lead 8 as shown by a solid line shown in FIG. 4(*a*) and welded to the electrode lead 8.

Then, also in a holder H3 forming an external electrode 20 of a discharge tube 18 shown in FIG. 5, a holder body 25 thereof is formed of a metal sheet bent into a shape of gripping and holding an outer periphery 24 of the discharge tube 18 in which the metal sheet has a shape of gripping and holding one end of the outer periphery 24 of the discharge tube 18 so as to dispose the other end of the outer periphery 24 thereof at a position opposing the end face 10 of an electrode seal portion 9L. Further, also in the holder H3, a tab terminal as a terminal 26 is formed from a portion of the metal sheet forming the main body 25 thereof, and the tab terminal 26 is bent so as to grip the electrode lead 8 as indicated by a solid line in FIG. 5(*a*) from a state indicated by a chain line and spot welded to the electrode lead 8. Further, although not illustrated in the drawing, a heat resistant adhesive is coated between the outer periphery 24 of the discharge tube 18 and the main body 25 of the holder H3 for holding the outer periphery, by which the discharge tube 18 is secured to the holder H3.

Then, also an external electrode 20 of a discharge tube 18 shown in FIG. 6 is formed as a holder H4 that holds the outer periphery 24 of a discharge tube 18 so as to oppose the end face 10 of an electrode seal portion 9L and secures the same to an electrode lead 8 protruding from the end face 10 thereof. The holder H4 is formed as a stepped metal tube in which a large diameter portion as a holder body 31 that holds the outer periphery 24 of the discharge tube 18 in a state of exposing the surface of the outer periphery 24 of the discharge tube 18 opposing the end face 10 of an electrode seal portion 9L, and a small diameter portion as a terminal 32 that secures and electrically connects the holder to the electrode lead 8 are contiguous with each other by way of a stepped portion 33.

In the stepped metal tube forming the holder H4, a pair of through holes 34, 34 are perforated to the large diameter portion as the holder body 31 for allowing the discharge tube 18 to be inserted therethrough in the diametrical direction and holding the both ends of the outer periphery 24 of the discharge tube 18, and the small diameter portion as the terminal 32 forms a sleeve terminal for allowing an electrode lead 8 to be inserted therethrough and securing the same to the electrode lead 8 by caulking and welding.

In the holder H4, as shown in FIG. 6 (*a*), the electrode lead 8 protruding from the end face 10 of the electrode seal portion 9L is at first inserted through the holder body (large diameter portion) 31 and the sleeve terminal (small diameter portion) 32 and then, as shown in FIG. 6 (*b*), the sleeve terminal (small diameter portion) 32 is engaged by caulking and welding to the electrode lead 8 and secured in a state of capping the holder body (large diameter portion) 31 over the end of the electrode seal portion 9L. Further, the discharge tube 18 inserted through the through holes 34 and 34 of the holder body 31 and held is secured at the portion protruding externally from the through holes 33, 33 of the holder body 31 to the outer surface of the holder body 31 by heat resistant adhesives.

INDUSTRIAL APPLICABILITY

The present invention contributes to the improvement of the starting performance of a high pressure discharge lamp used as a light source apparatus for liquid crystal projectors, DLP projectors, etc.

The invention claimed is:

1. A light source apparatus including a high pressure discharge lamp in which a pair of electrodes are opposed each other, at least mercury and a starting gas are sealed in a discharge bulb of an arc tube, a pair of electrode seal portions sealing each of the electrodes are formed by airtightly sealing portions from the discharge bulb to both ends of the arc tube, and connected to a lighting circuit by way of electrode leads protruding from the end faces of the respective electrode seal portions;

a concave reflector in which the lamp is attached by being inserted at one of the electrode seal portions through a bottom hole opened in the bottom of the reflector; and a UV-enhancer that radiates a UV-light to the discharge bulb for enhancing the starting performance of the lamp upon starting lighting, wherein the UV-enhancer has a discharge tube which is connected in parallel with the lamp to the lighting circuit for applying a starting voltage between the electrodes upon starting lighting of the lamp and which generates a UV-light by application of the starting voltage between an external electrode and an internal electrode, the external electrode of the discharge tube is formed of a metal holder that holds the outer periphery of the discharge tube so as to oppose the end face of one of the electrode seal portions and secures the same to the electrode lead protruding from the end face thereof, and the holder includes a holder body that holds the outer periphery while exposing the surface of the outer periphery opposing the end face of one of the electrode seal portions and a terminal for securing and electrically connecting the holder to the electrode lead.

2. A light source apparatus according to claim 1, wherein the holder body is formed of a metal sheet bent into a shape of gripping and holding the outer periphery of the discharge tube.

3. A light source apparatus according to claim 2, wherein the metal sheet is bent into a shape of gripping and holding the outer periphery of the discharge tube at a position opposing the end face of one of the electrode seal portions, and a window is formed to the metal sheet for exposing the surface of the outer periphery opposing the end face.

4. A light source apparatus according to claim 2, wherein the metal sheet is bent into a shape of gripping and holding the outer periphery of the discharge tube so as to expose the surface of the outer periphery of the discharge tube opposing the end face of one of the electrode seal portions at a position opposing the end face.

5. A light source apparatus according to claim 2, wherein the metal sheet is bent into a shape of gripping and holding one end of outer periphery of the discharge tube so as to situate the other end of the outer periphery of the discharge tube to a position opposing the end face of one of the electrode seal portions.

6. A light source apparatus according to claim 2, wherein a tab terminal as the terminal is formed with a portion of the metal sheet.

7. A light source apparatus according to claim 1, wherein the holder is formed of a stepped metal tube where a large diameter portion as the holder body and a small diameter portion as the terminal are contiguous by way of a step each other, a pair of through holes are perforated in the large diameter portion for allowing the discharge tube to be inserted therethrough in the diametrical direction for holding both ends of the outer periphery of the discharge tube, and the small diameter portion has a sleeve terminal allowing the electrode lead to be inserted therein and securing the same to the electrode lead.

8. A light source apparatus according to claim 1, wherein the body of the discharge tube is formed of a glass sealing tube made of quartz glass in which a metal foil as the internal electrode is contained and disposed, and a rare gas is sealed.

9. A light source apparatus according to claim 3, wherein a tab terminal as the terminal is formed with a portion of the metal sheet.

10. A light source apparatus according to claim 4, wherein a tab terminal as the terminal is formed with a portion of the metal sheet.

11. A light source apparatus according to claim 5, wherein a tab terminal as the terminal is formed with a portion of the metal sheet.

12. A light source apparatus according to claim 2, wherein the body of the discharge tube is formed of a glass sealing tube made of quartz glass in which a metal foil as the internal electrode is contained and disposed, and a rare gas is sealed.

13. A light source apparatus according to claim 3, wherein the body of the discharge tube is formed of a glass sealing tube made of quartz glass in which a metal foil as the internal electrode is contained and disposed, and a rare gas is sealed.

14. A light source apparatus according to claim 4, wherein the body of the discharge tube is formed of a glass sealing tube made of quartz glass in which a metal foil as the internal electrode is contained and disposed, and a rare gas is sealed.

15. A light source apparatus according to claim 5, wherein the body of the discharge tube is formed of a glass sealing tube made of quartz glass in which a metal foil as the internal electrode is contained and disposed, and a rare gas is sealed.

16. A light source apparatus according to claim 6, wherein the body of the discharge tube is formed of a glass sealing tube made of quartz glass in which a metal foil as the internal electrode is contained and disposed, and a rare gas is sealed.

17. A light source apparatus according to claim 7, wherein the body of the discharge tube is formed of a glass sealing tube made of quartz glass in which a metal foil as the internal electrode is contained and disposed, and a rare gas is sealed.

18. A light source apparatus according to claim 9, wherein the body of the discharge tube is formed of a glass sealing tube made of quartz glass in which a metal foil as the internal electrode is contained and disposed, and a rare gas is sealed.

19. A light source apparatus according to claim 10, wherein the body of the discharge tube is formed of a glass sealing tube made of quartz glass in which a metal foil as the internal electrode is contained and disposed, and a rare gas is sealed.

20. A light source apparatus according to claim 11, wherein the body of the discharge tube is formed of a glass sealing tube made of quartz glass in which a metal foil as the internal electrode is contained and disposed, and a rare gas is sealed.

* * * * *